US010883336B2

(12) United States Patent
Prieur et al.

(10) Patent No.: US 10,883,336 B2
(45) Date of Patent: Jan. 5, 2021

(54) WELL ABANDONMENT USING VIBRATION TO ASSIST CEMENT PLACEMENT

(71) Applicant: CONOCOPHILLIPS COMPANY, Houston, TX (US)

(72) Inventors: Jean-Marie Prieur, Aberdeen (GB); Andrew Hood, Aberdeen (GB); Ian Milne, Aberdeen (GB); Stephen Cromar, Aberdeen (GB)

(73) Assignee: CONOCOPHILLIPS COMPANY, Houston, TX (US)

( * ) Notice: Subject to any disclaimer, the term of this patent is extended or adjusted under 35 U.S.C. 154(b) by 693 days.

(21) Appl. No.: 15/211,762

(22) Filed: Jul. 15, 2016

(65) Prior Publication Data

US 2017/0016305 A1 Jan. 19, 2017

Related U.S. Application Data

(60) Provisional application No. 62/193,801, filed on Jul. 17, 2015.

(51) Int. Cl.

| | |
|---|---|
| ***E21B 33/134*** | (2006.01) |
| ***E21B 33/13*** | (2006.01) |
| ***E21B 28/00*** | (2006.01) |

(52) U.S. Cl.

CPC ..... *E21B 33/134* (2013.01); *E21B 28/00* (2013.01); *E21B 33/13* (2013.01)

(58) Field of Classification Search

CPC ..... E21B 33/134; E21B 28/00

(Continued)

(56) References Cited

U.S. PATENT DOCUMENTS 2,072,982 A 3/1937 Dale
2,769,498 A * 11/1956 Huber ..... E21B 33/134 166/66.4

(Continued)

FOREIGN PATENT DOCUMENTS

| | | |
|---|---|---|
| CN | 102889067 A | 1/2013 |
| WO | 2013085621 | 6/2013 |
| WO | 2014117846 | 8/2017 |

OTHER PUBLICATIONS

Cooke, et al., "Primary Cementing Improvement by Casing Vibration During Cement Curing Time", SPE Production Engineering, Aug. 1988.

(Continued)

*Primary Examiner* — Zakiya W Bates
*Assistant Examiner* — Ashish K Varma
(74) *Attorney, Agent, or Firm* — Conocophillips Company

(57) ABSTRACT

A method of cementing an oil or gas well for abandonment comprises cutting the production tubing 6 above the production packer 8, setting a tubing plug 9 in the tubing and then cutting the tubing. A bridge plug may be installed at the level of the cut, which spans the full diameter of the well casing 3. An agitator assembly 20 comprising an agitator 24, packer 21 and burst sub 23, with a running tool fitted to the top, is run down the tubing on wire line. Cement is then injected into the tubing 6, which flows through the agitator assembly and causes the tubing to vibrate. The cement fills the tubing but also flows back up the A annulus between the casing and production tubing. Vibration of the tubing assists the formation of a good quality cement plug extending all around the annulus over a substantial length of the well.

19 Claims, 2 Drawing Sheets

(58) Field of Classification Search
USPC ..... 166/286
See application file for complete search history.

(56) References Cited

U.S. PATENT DOCUMENTS

| | | | | |
|---|---|---|---|---|
| 3,113,621 | A | 12/1963 | Krueger et al. | |
| 4,512,401 | A | 4/1985 | Bodine | |
| 6,009,948 | A | 1/2000 | Flanders et al. | |
| 2007/0187112 | A1* | 8/2007 | Eddison | E21B 31/005 166/380 |
| 2010/0212901 | A1 | 8/2010 | Buytaert | |
| 2012/0118567 | A1 | 5/2012 | Cooke, Jr. | |
| 2015/0308219 | A1* | 10/2015 | Larsen | E21B 33/14 166/285 |
| 2017/0163783 | A1 | 6/2017 | Martino et al. | |

OTHER PUBLICATIONS

International Search Report for related case, App. No. PCT/US2016/042583, dated Dec. 2, 2016.

* cited by examiner

WELL ABANDONMENT USING VIBRATION TO ASSIST CEMENT PLACEMENT

CROSS-REFERENCE TO RELATED APPLICATIONS

This application is a non-provisional application which claims benefit under 35 USC § 119(e) to U.S. Provisional Application Ser. No. 62/193,801 filed Jul. 17, 2015, entitled "WELL ABANDONMENT USING VIBRATION TO ASSIST CEMENT PLACEMENT," which is incorporated herein in its entirety.

STATEMENT REGARDING FEDERALLY SPONSORED RESEARCH OR DEVELOPMENT

None.

FIELD OF THE INVENTION

This invention relates to the abandonment of oil and gas wells and specifically to the plugging of wells using cement or other settable medium, e.g. when they have reached the end of their productive life. The invention also relates to a device for plugging a well and to a plugged well.

BACKGROUND OF THE INVENTION

When an oil or gas well is no longer economical or if there is some problem with the well which means that production is no longer possible or that well integrity has been compromised in some way, or for other reasons, the well may be abandoned. It is necessary to plug the well before abandoning it, e.g. to prevent seepage of hydrocarbon product from the well. Commonly, plugging may be achieved by injecting a settable substance or medium, e.g. cement, into the well.

It is necessary to ensure that a full barrier extending across the full diameter of the wellbore is created, from rock to rock. The well will normally be lined with a steel casing, and commonly cement will have been placed between the casing and the rock formation when the well was initially created. Provided this cement is in good condition, the well may be plugged effectively by leaving the casing and original cement in position and placing further cement in the interior of the steel casing.

While the well is producing oil and/or gas, steel production tubing extends though the well, within the casing. The production tubing is connected to a complex arrangement of valves at the wellhead known as a Xmas tree. In a plugging operation, normally the Xmas tree is removed and a blowout preventer is installed on the wellhead in order to retrieve the production tubing. The production tubing is then removed, a packer installed in the casing and cement then pumped down the well. A liquid cement column is then formed with its base on the packer; once the required length of column has been delivered the cement is left to set and a plug thereby established.

Generally, this technique reliably forms an effective cement plug. However, removal of the Xmas tree and production tubing is time consuming and expensive and another theoretical approach is to deliver cement through the production tubing without removing either tubing or Xmas tree. It is possible to cut or perforate the tubing above the production packer and then to inject cement into the well through the production tubing so that it flows out of the cut end or perforations of the production tubing and back up into the annular space between the casing and tubing as well as filling the interior of the tubing. In this way, a cement plug can, theoretically at least, be established which spans the whole cross section of the well, without removing the tubing and Xmas tree. The cost advantages of this technique, if it can be achieved, would be considerable.

Unfortunately, a cement barrier formed using this technique is often found to be inadequate and therefore the technique is not a practical one. Without wishing to be bound by theory, the inventors believe the main reason for this is that the production tubing is not usually centrally positioned in the casing and, due to its viscosity, the cement may not be able to pass between the casing and tubing when they are close together or in contact.

Unlike casing (i.e. the outer steel tubing of a well) which is typically centralized in the wellbore and spaced from the bare rock using spacers, tubing is centralized at the top and bottom of the well only. The length and flexibility of the tubing are such that it inevitably rests against the inside of the casing over a large proportion of its length. This will be the case even in a well which is essentially vertical since an incline of only a fraction of a degree will mean that the tubing does not hang centrally within the casing. Contact between the tubing and the interior of the casing is likely to be snug, because both surfaces are smooth machined surfaces.

Without wishing to be bound by theory, the inventors believe this is why the resulting cement plug tends not to form a fully isolating radial bond around the tubing, or at least not over a sufficient length of the tubing.

There may also be other reasons why the cement barrier is found to be inadequate, which may not at present be understood fully by the inventors.

Agitation of cement to improve the quality the set cement is a known technique generally. In the oil and gas business, it is known (at least from academic papers and patent publications) to agitate the casing when cementing in a casing into a wellbore. That is to say, when a well is being prepared, cement may be placed in the annular space between the formation rock and the outer surface of the casing and, during this process, the casing may be moved back and forth. This is relatively easy to achieve since there is easy access to the casing at the wellhead to allow the casing to be moved.

As a result of casing movement, the cement is agitated during setting; it has been suggested that this improves the quality of the cement itself, and also reduces problems created by an under-pressure developing as the cement sets. This is described, for example in U.S. Pat. No. 2,072,982 (Dale), US2012/0118567 (Cooke) and other patent publications, as well as in Cooke et al., "Primary Cementing Improvement by Casing Vibration During Cement Curing Time", *SPE Production Engineering*, August 1988. US2010/0212901 (Buytaert) suggests that agitation can help advance a casing through a highly deviated well when the casing is being introduced into the well because the agitation may lift the weight of the casing away from the rough, irregular rock surface of a horizontal or near horizontal well. It has also been suggested that in such a highly deviated horizontal or near horizontal well, agitation may assist cement to access places where the casing rests upon the rock surface, by lifting the weight of the casing away from the rock—see U.S. Pat. No. 4,512,401 (Bodine).

It has been suggested briefly and in general terms in WO2014117846A1 (Statoil) that agitation could be used to assist the setting of cement during abandonment of an oil or gas well. However, there remains a significant un-met need for a reliable cementing technique which will allow a plug and abandon operation to be performed without removal of the Xmas tree and production tubing.

SUMMARY OF THE INVENTION

The invention more particularly includes a process for plugging a hydrocarbon well for abandonment, wherein the well comprises a casing and tubing (e.g. production tubing), the process comprising the steps of:

(a) setting a plug in the tubing;

(b) cutting or perforating the tubing above the plug;

(c) injecting a settable medium into the tubing such that it passes into an annular space between the tubing and the casing;

(e) during and/or after the injection of settable medium, moving (e.g. reciprocally) or agitating the tubing in order to allow or induce the settable medium to enter the full circumference of the annular space.

The term "hydrocarbon well" includes any well used generally in hydrocarbon production, even if not a producing well. For example, the term includes gas or water injector wells or water production wells. The well to be abandoned could be a sidetrack well, e.g. in a slot recovery procedure.

The well may be a generally vertical well, or the part of the well over which a settable medium needs to be placed may be generally vertical. Generally vertical means having a maximum inclination to the vertical of 40 degrees. Alternatively, the well, or the part of the well over which a settable medium needs to be placed, may be described as not highly deviated, which is to say it makes a minimum angle of 45 degrees with respect to the horizontal. However, the inventors believe that the inventive technique will, in fact, be effective in wells of any angle including highly deviated wells.

The settable medium could be any material capable of being introduced into the tubing in a flow-able form and which can then set in a solid form to create an isolating plug. The settable medium could also be called an isolation material. The most common example is cement, such as a cement prepared specially for plugging oil and gas wells, but a settable resin or other material could also be used.

The inventors have found that the quality of a plug created using the invention is very good. In fact, the degree of improvement compared with the results of their efforts to set similar plugs with static tubing has been very surprising. It has been found that the length of satisfactory cement plug which can bet set using the invention can be at least twice the length of satisfactory cement plug which can be set in static tubing.

It will be understood that achieving an inadequate cement job means going back and doing the cement job again, but first removing all the tubing and cement from the previous job and then performing a normal cementing job; this involves much greater cost that taking out the tubing and Xmas tree to start with. It is therefore of the utmost importance to be able reliably to create a cement plug of sufficient length and quality. The inventors believe the invention makes through-tubing cement plugging feasible when it was not so before.

The movement or agitation may be caused by an agitator device placed in the tubing, normally prior to injection of the settable medium. The agitator device may be placed in the tubing adjacent the cut or perforations in the tubing and, optionally, one or more further agitator devices may be placed at different points in the tubing.

The agitator device may be of the type which is energized by fluid, such as the settable medium, passing through the agitator device. The agitator may be placed by means of coil tubing, wireline or E-line.

Alternatively, instead of an agitator device, the flow of cement or other settable medium may be pulsed. As with an agitator device, this may cause agitation of both the cement and the tubing. Pulsing of cement could be achieved at the pump (at the surface) by bypassing the pump damping chamber to cause pulsing, alternatively with a choke dimensioned so as to cause a resonant, pulsed flow at the appropriate flow rate with the chosen settable medium. The power to the pump could also be varied cyclically to create pulsing. Another possibility would be to create the pulsing down the tubing near to where the settable medium is to be deployed; this could be done with a choke as explained above, or by other means.

In one embodiment, when the tubing has been cut rather than just perforated, a further plug (a bridge plug) may be placed across the internal diameter of the casing, adjacent the cut, prior to the injection of settable medium or cement. The agitator device, or other means of agitation, may cause vibration (which could be called reciprocal movement) of the tubing in any direction. In the case of an agitator, he vibration, in the region of the agitator, may have a mean or minimum amplitude in the direction transverse to the tubing of at least 10 mm, such as between 10 mm and 500 mm, optionally between 10 mm and 300 mm, e.g. between 10 mm and 160 mm; alternatively, between 30 mm and 500 mm, such as between 30 mm and 300 mm, e.g. between 30 mm and 160 mm; or alternatively between 60 mm and 500 mm, such as between 60 mm and 300 mm, e.g. between 60 mm and 160 mm. In the case of direct pulsing of cement, this range of movement of the tubing may be expected at some position along the length of tubing over which the cement plug is to be set.

If an agitator is used, then at a distance of 2000 ft along the tubing from the agitator, the vibration may have a mean or minimum amplitude in the direction transverse to the tubing of at least 5 mm, such as between 5 mm and 300 mm, optionally between 5 mm and 200 mm, e.g. between 5 mm and 100 mm; alternatively, between 10 mm and 300 mm, such as between 10 mm and 200 mm, e.g. between 10 mm and 100 mm; or alternatively between 30 mm and 500 mm, such as between 30 mm and 200 mm, e.g. between 30 mm and 100 mm.

The agitator device may cause vibration of the tubing which, at a distance of 2000 ft along the tubing from the agitator, has a mean or minimum amplitude in the axial direction of at least 5 mm, such as between 5 mm and 200 mm, e.g. between 10 mm and 100 mm.

Whatever means is used to cause the vibration or reciprocal movement of the tubing, the degree of vibration may be maximized by tuning the vibrational input (including pulsing of cement) to the harmonics of the tubing, e.g. causing the tubing to vibrate at or near a resonant frequency. The frequency of vibration may be tuned, e.g. by changing the design of the agitator, changing the diameter of a choke, changing the frequency of an oscillating power source, etc.

In another embodiment of the invention, an agitator assembly is provided which may be capable of being run through production tubing in a hydrocarbon well. The assembly may comprise: (a) a plug or packer capable of being activated to anchor the assembly at a selected point in the production tubing, whilst allowing fluid to flow through the tubing; and, assembled thereto (b) an agitator device for producing vibration or reciprocal movement of the tubing.

Optionally, fluid flowing through the agitator device may create vibration or reciprocal movement of the tubing.

The assembly may further comprise a burst sub and/or a running tool and/or a non-return valve. The latter is ideally incorporated between the agitator device and packer, but it could go anywhere in the assembly.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
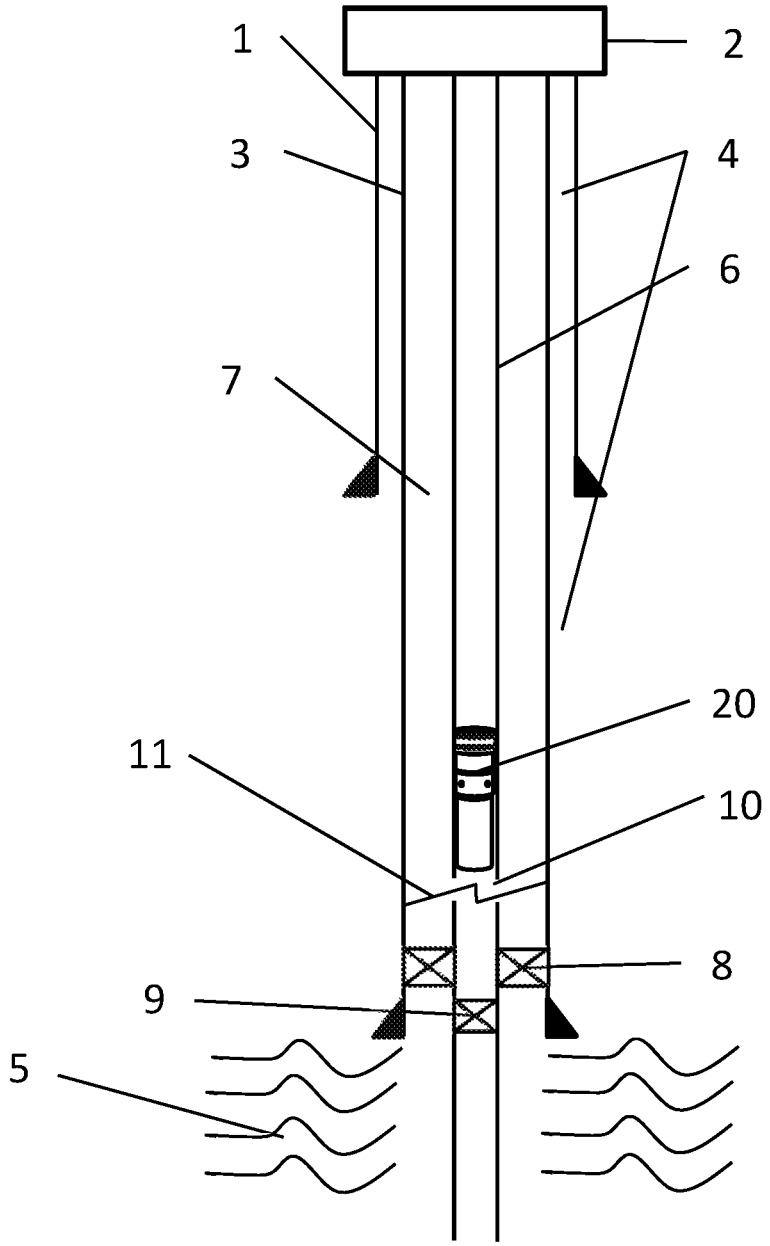
FIG. 1 is a high-level schematic cross section of a hydrocarbon well undergoing a plugging process in accordance with the invention.

Referring to the schematic well section of FIG. 1, intermediate casing 1 lines the uppermost section of the well from the wellhead and Xmas tree 2 to a given depth. This is highly variable depending on the type of well. Concentrically within this large diameter casing is the so called production casing 3 which extends from the Xmas tree and, in the well of FIG. 1, down to a depth just above the reservoir 5. It is possible for the well to be provided with successively smaller diameters of casing (liners) which do not extend to the surface but are suspended from the casing above.

The annular space 4 (referred to as the "B annulus") between the casing and the rock formation is filled with cement after installation of the casing. The cement prevents hydrocarbons from the reservoir seeping to the surface via the annular space behind the casing.

Extending down from the Xmas tree 2 inside the casing 1, 3 is steel production tubing 6, through which hydrocarbon product travels from the reservoir to the surface. Between the production casing 3 and the tubing 6 is an annular space 7 known as the "A annulus". The A annulus is sealed from the reservoir by a production packer 8 located just above the reservoir; during production this prevents seepage of hydrocarbons to the surface via the A annulus. Although fixed in a concentric position within the casing both at the Xmas tree and at the production packer, the production tubing can be many thousands of feet/meters long and the well will usually deviate somewhat from vertical. The production tubing therefore cannot be maintained in a truly concentric relationship with the casing over its full length, and will normally be in contact with the interior of the casing over much of its length.

In FIG. 1, production has ceased and the well is shown undergoing a plugging process so that it may be abandoned. A tubing plug 9 has been installed in the production tubing. In FIG. 1 the plug 9 has been installed just below the production packer; however, the exact position is not important and it may be installed above or at the same level as the production packer.

Above the plug 9, the production tubing has been cut at 10 and the production tubing generally moves apart due to tension in the string, so that the interior of the tubing communicates with the A annulus. Located in the cut is a further plug or base plug 11 extending across the full internal diameter of the casing 3. The base plug 11 has been pumped through the production tubing and may be e.g. an inflatable device or alternatively may be composed of a settable or hardening substance which has been delivered initially in non-rigid or liquid form (commonly known as a viscous reactive pill).

Figure 2:
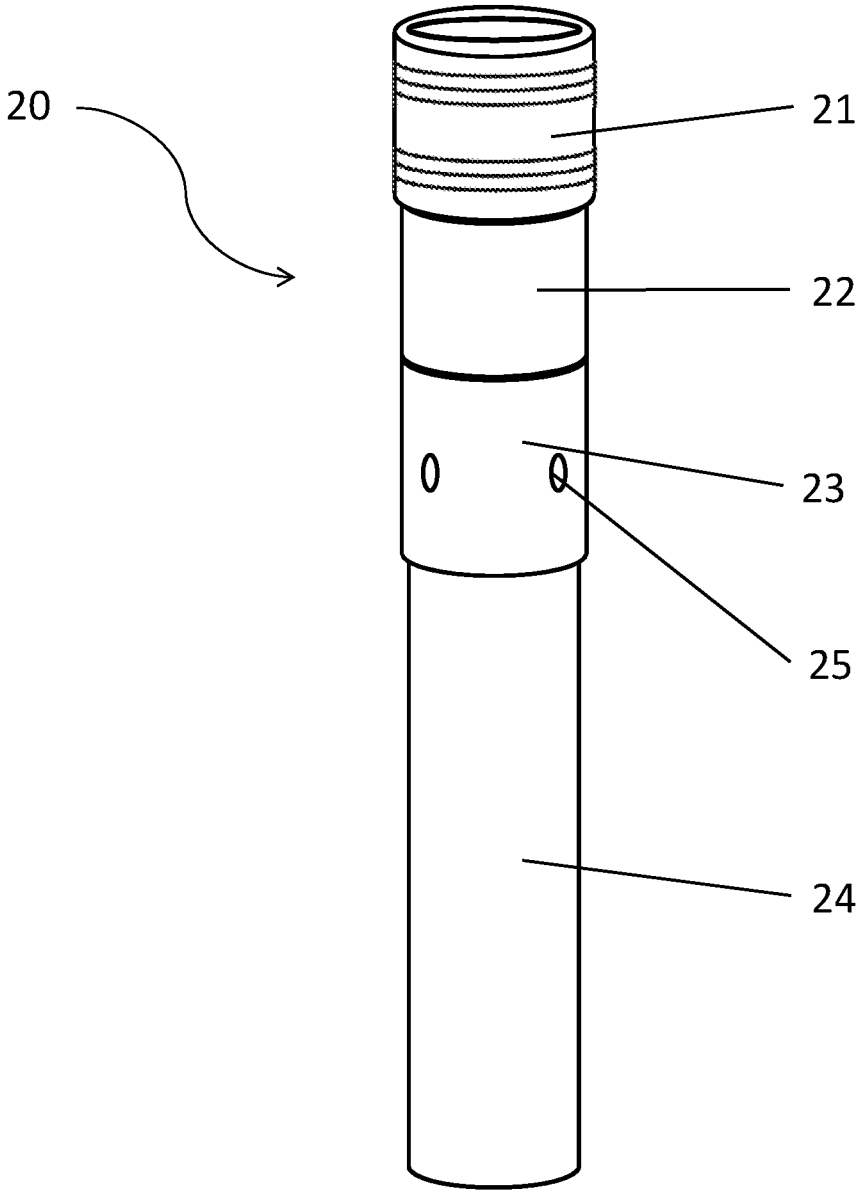
FIG. 2 is a side view of an agitator and packer assembly for use in a plugging process in accordance with the invention.

Located in the production tubing above the cut is an agitator assembly 20 which has been placed in the tubing using wire line. More details of the agitator assembly 20 are shown in FIG. 2. At the upper end of the agitator assembly 20 is a packer 21. The packer 21 is of a type which can be delivered to a desired location and then activated to cause it to anchor itself in the tubing, but which does not prevent flow of fluid through the tubing. A suitable packer is a 5½" EZSV packer produced by Halliburton, but any similar device could be used.

Mounted to the lower end of the packer 21 is a cross-over sub 22. The function of this component is to allow components with different connection types to be made up to each other. This component is not integral to the application as the packer 21 and burst sub 23 can be manufactured to have the same connection.

Mounted to the lower end of the cross-over sub 22 is a burst sub 23. The function of this component is to allow an alternative flow path if the agitator becomes plugged. This is done by rupturing discs 25 in the burst sub, to allow flow through apertures which are otherwise sealed by the rupturable discs. The burst sub 23 is conventional in itself, and a person skilled in this field would be familiar with its design and function.

Mounted to the lower end of the burst sub 23 is a 3½" agitator 24. The agitator 24 is a hollow tubular device with interior rotor running through the middle. Fluid may flow through the agitator which will turn the rotor causing two discs to oscillate, creating pressure pulses which generate tubing movement.

In this embodiment, the agitator is produced by National Oilwell Varco but another agitator may be used. Agitators are normally used for other purposes and are not normally delivered through production tubing. A somewhat narrower design than normal is required in order for the agitator to fit in the tubing, but in other respects the design is conventional. The design of the agitator is not the subject of the present invention.

Made up to the top of the packer (but not shown in the drawing) would be a standard running tool which connects to the wire line. Once the packer is set, the running tool can be disconnected and retrieved with the wireline, leaving only the agitator assembly 20 downhole.

In an alternative embodiment (not shown in the drawings), a non-return valve is included in the assembly shown in FIG. 2. In this alternative embodiment, the non-return valve is located between the agitator device and packer; this is the preferred position but it could be located elsewhere in the assembly.

When a well such as the well shown in FIG. 1 reaches the end of its production life, a plug and abandon operation is necessary. A plugging operation according to the invention using the apparatus described above may involve the following steps.

The first step is to evaluate the existing cement in the B annulus. Although this cement can degrade over time and potentially allow seepage of hydrocarbons to the surface, often it remains intact and this can be verified by logging. Alternatively, historical logs or cement records can be used as a means of verifying cement placement in the B annulus. Any sign of seepage at the surface is an obvious indication that the cement is not providing an effective seal. Provided the evaluation is satisfactory, a "through tubing" plugging procedure can be carried out. In future a logging tool may be run through the tubing to assess the B annulus cement but this technology does not currently exist.

The tubing plug 9 is delivered and set using wire line techniques. This operation is well known in itself and a skilled person in this field would be familiar with the operation. Once the wire line has been withdrawn, a tubing cutting device is then passed down the tubing 6 using wire line and a cut made in the tubing. Again this operation is conventional and the details would be known to someone skilled in this field.

The tubing 6 is normally under a degree of tension and therefore, when it is cut, the cut ends spring apart and leave a gap 10. How large the gap is and what determines the size of the gap is not currently well understood and is under investigation by the inventors.

The next step is to install the base plug 11 which is to form the base for the new cement. Again, the techniques are not new and any person skilled in this field would be familiar with them. An inflatable plug or a viscous reactive pill is pumped down the tubing 6 using wire line until it reaches the cut 10. The depth of the cut is known since the cut was also made using wireline and the depth is easily determined from the length of wire used. The base plug 11 is then set across the full interior diameter of the casing 3 and the wireline withdrawn.

The agitator assembly 20 is then made up on the surface. The various components of the agitator assembly are each known in themselves but the assembly of these components is not and the purpose of the assembly 20 is a new one.

Each of the components in FIG. 2 is screwed together and torqued up to the rating of the various connections involved. The packer 21 is activated via an electric signal sent from surface and down the wire line. Alternatively, a timer function can be used and the packer can be programmed to set at a pre-determined time. The burst discs 25 in the burst sub 23 can be activated if the agitator 24 becomes plugged. If this were to happen, pressure would be increased down the production tubing to rupture the burst discs 25, allowing flow to exit apertures otherwise sealed by the burst discs 25 and by-pass the plugged agitator tool 24.

The agitator 24 has a rotor that passes through the middle. On the end of the rotor is a disc with another fixed disc directly below. The discs are slightly offset and as the rotor turns when fluid passes through the tool, the discs oscillate creating a pressure pulse in the fluid column. Tubing movement is then generated as a result of this pressure pulse. The design of the agitator itself is not the subject of this invention.

The agitator assembly is then attached to wire line and delivered through the Xmas tree into the tubing 6. It is lowered to the desired point just above the base plug 11, with the agitator located entirely within the tubing for protection, and the packer 21 then activated by an electric signal sent down the wire line from the surface to anchor the assembly. With the agitator assembly 20 in position, the wire line is then detached and withdrawn. Cement of a calculated density is then injected into the tubing 6, with continuous monitoring of the volume dispensed, the volume flow rate and the pressure (back pressure/injection pressure). Using this information together with knowledge of the depth of the base plug, it is possible to calculate the length of the cement column both inside the tubing 6 and in the A annulus 7.

As well fluid and cement flows through the agitator, it engages with the rotor in the interior of the agitator and causes the discs to oscillate, causing tubing vibration. The vibration can be in any direction, e.g. vertical or horizontal or some other direction, or it may be in many different directions. It may be somewhat random or it may be regular. The exact nature of the vibration or reciprocal movement will depend not only on the design of the agitator but also on the nature (e.g. viscosity) of the fluid passing through it as well as the pressure and flow rate of the fluid The movement or vibration is transmitted to the tubing 6 and it is believed that a considerable length of the tubing 6 is subject to significant movement. The effect of this is to allow the cement to pass between the tubing 6 and casing 3 all the way round. It is not certain whether this is because the vibration moves the tubing at least temporarily away from the interior wall of the casing, allowing the cement to pass between the tubing 6 and casing 3, or whether the vibration has some pumping effect on the cement or whether it aids flow of the cement in some other way. However, from later analysis of the cement job it is evident that the cement had been able by whatever means to pass all around the tubing and thus create a full plug over a substantial length of the tubing.

The trials described below (Examples 1 and 2) were performed using a flow rate which caused the tubing to vibrate at its natural frequency; this rate differs from well to well and is calculated prior to the job. The reason for choosing this flow rate is that if the agitator is vibrating at the tubing system's natural frequency it will generate the largest amount of movement. However, it is at present not known if the application would be as successful or even more successful when moving the tubing at a frequency different to its natural frequency.

The trials described below use a 5½" EZSV packer and a 3½" NEO agitator. The cement that was pumped was 16.0 ppg slurry of the type marketed by Halliburton Energy Services under their trademark Abandacem. For all offshore trials approximately 3,500 ft of tubing was run into the hole and approximately 2,000 ft of cement was pumped behind the tubing. The cement results were logged using an ultrasound cement bond logging tool from Halliburton marketed under the trademark Cast-M, which uses ultrasonic to assess cement presence and cement bond behind a casing string. This was used in conjunction with a conventional acoustic cement bond logging tool (CBL). The results were analyzed by a logging specialist to determine the quantity and quality of cement.

The Cast-M tool emits circumferential ultrasonic high frequency pulses from a rotating head with 54 pulses emitted over a full 360 degree rotation. The tool measures reflected ultrasonic waveforms from the inner and outer surfaces of the first string of tubing/casing. Various parts of the reflected waveform provide information about the surfaces which the waveform is being reflected from as well as the materials which are in contact with these surfaces. The waveform amplitude provides information of the casing condition from the first arrival, whereas the acoustic impedance indicates the presence of cement (or whatever else) that is in contact with the reflective surface. These measurements are taken every eight centimeters (or less) of tubing length. The Cast-M tool provides a cement map (360 degree view) of cement coverage around the borehole. What is cement and not cement is governed by the measured acoustic impedance translated into a color map.

Lab based measurements of cement compressive strength were made. Using in-house logging contractor interpretation charts, these compressive strengths can be converted to an equivalent expected amplitude that would be recorded by the conventional acoustic cement bond logging tool (CBL). These amplitude cut-offs applied to the CBL amplitude curve, are used in addition to the cement map from the CAST-M, whereby good cement coverage exists when there is a suitable cement coverage from CAST-M and the CBL amplitude is below the specific cut-off for fully bonded cement (of a given compressive strength).

The stage of setting of cement varies with depth because of temperature differences, and this can be predicted reasonably accurately for different depths at a given time. The empirical relationships are used to test cement quality at different depths, relying also on interpolated values. However, the main objective of the Cast-M tool was to assess the presence of a cement bond over the full 360 degrees of the tubing over a given length. In the event of no bond for even a few degrees of the tubing circumference at a given distance along the tubing, the Cast-M tool measurements will indicate no cement is present.

The offshore trials were performed in real wells but for the present purposes these will be referred to as Wells 1, 2, 3, 4 and 5.

The following examples are given. Each example is provided by way of explanation of the invention, and the following examples should not be read to limit, or define, the scope of the invention.

Example 1

An onshore trial was performed to assess the feasibility of the agitator assembly comprising a packer and agitator device under operational conditions and to assess the extent of tubing movement generated by the agitator. 9⅝" casing was run into a test well to approximately 3,200 ft and filled with heavy mud with similar properties to cement used in abandonments. Approximately 3,000 ft of 5½" tubing was then run into the hole with a pre-set packer and agitator in the tubing. Two black box subs were also installed in the string at 1,000 ft and 2,000 ft behind the agitator. The subs contained accelerometers to record any lateral or axial acceleration generated. The 5½" tubing was then locked down to simulate a through-tubing abandonment.

The heavy mud was then pumped around the well at varying flow rates between 110-210 gallons per minute for an extended duration of approximately 6.5 hours. Pressure indications on surface indicated that the agitator was pulsing throughout the duration of the trial. The tubing and black boxes were then retrieved to the surface along with the packer and agitator. A visual inspection was performed of the packer and agitator with both appearing to be in good condition. The black boxes were then analyzed and they showed good tubing movement along the entire length of the string. Analysis of the data converted the acceleration into displacement and showed lateral potential displacement of up to 160 mm at 1,000 ft behind the agitator and lateral potential displacement of up to 70 mm at 2,000 ft behind the agitator. Axial potential displacement was 10-20 mm at 1,000 ft behind the agitator and 10-80 mm at 2,000 ft behind the agitator. This test proved that the packer and agitator assembly could withstand operational conditions during a well abandonment. In addition, it also proved that the agitator generated tubing movement along the length of the string.

Example 2

Following successful onshore trials, the focus was moved to performing offshore trials. 3,000 ft of 5½" open-ended tubing was cemented into 9⅝" casing under static conditions in Well 1. Cement was placed into the A annulus and final displacement pressure was held to prevent cement from flowing back inside the tubing, meaning the interior of the tubing was left clear. The cement in the A annulus was then logged to assess quantity and quality. The result of this log showed that there was 733 ft out of 2,000 ft of cement that can be termed as acceptable for abandonment purposes.

Example 3

A similar trial was repeated on Well 2 but this time, a similar packer and agitator assembly to the one used in the onshore trial was run into the 5½" tubing on wire line and set at the bottom of the tubing. 2,000 ft of cement was then pumped through the agitator and into the A annulus. Again, final displacement pressure was held to prevent cement from flowing back inside the tubing, leaving the inside of the tubing clear. The results were then logged for quality and quantity. The results showed that the cement quality was poor and only 10 ft was deemed to be acceptable for abandonment purposes. It is uncertain whether these bad results were due to the poor integrity of the production tubing in this well or the fact no base plug was set for the cement. Either of these are considered by the inventors to be possible causes, or there may be another cause. There is also the possibility that human or mechanical error contributed towards the poor result.

Example 4

The trial was repeated on Well 3 but this time, a bridge plug was set in the production casing prior to running the 5½" tubing and agitator assembly. Final displacement pressure was held to prevent cement from flowing back inside the tubing, leaving the inside of the tubing clear. However, at some point during this, the pressure bled off for unknown reasons meaning there was a low pressure held inside the tubing. The results were then logged for quality and quantity and showed that there was 1,310 ft of cement that was deemed to be acceptable for abandonment purposes. This test proved that the agitator improves the quality and quantity of good abandonment cement in the A annulus by generating tubing movement. The cement results are not as good when cement is pumped through static tubing.

Example 5

Following learnings from the trial on Well 3, a similar trial was performed on Well 4 to prove the previous good result. Again, a bridge plug was set in the casing prior to running the 5½" tubing and agitator assembly. Final displacement pressure was held to prevent cement from flowing back inside the tubing, leaving the inside of the tubing clear. The result was logged but showed that there was no cement that could be deemed to form a competent barrier.

The inventors considered possible causes of the poor result given the success of the trial on Well 3. The inventors concluded that the only difference was the fact the pressure had bled off on Well 3 when holding it on the inside of the tubing. All logs on the trials had been run without pressure inside the tubing. Pressure was re-applied to the tubing and another log was run showing an improved quantity of cement of 363 ft. It was apparent to the inventors that by holding pressure inside the tubing as the cement set, the tubing was ballooning and when the pressure was released to run the log, a small annulus was formed between the cement and outside of the tubing meaning the log could not see any cement over these areas. This observation is of course only relevant to the trials, where the pressure in the tubing is maintained to avoid the interior filling with cement so that a logging tool can be passed down the tube to assess the condition of the cement in the annulus. In a real plug and abandon operation the interior of the tube would of course also be filled with cement and there would be no need to maintain pressure.

Example 6

The final trial was performed on Well 5. In this well, a bridge plug was set in the casing and a non-return valve was run on the 5½" tubing. The agitator was then run and 3,100 ft of cement was pumped. Once the cement was pumped, no pressure was held on the inside of the tubing. After waiting on cement to set, the tubing was logged. The log showed 2,572 ft of good cement which equates to 84% of good cement out of the total volume pumped. The final trial confirmed that if a base is provided for the cement plug and the pressure inside and outside the tubing are equal when the plug is placed, then the agitator will provide improved cement isolation. The conclusion when comparing trials on Well 1 and Well 5 is that the agitator doubles the amount of good cement which is deemed suitable for isolation. The successful trials on Well 3 and Well 5 showed a reduction in channeling and a good cement bond around the entire string with no low-side being apparent.

In Examples 2 and 3 above, the quoted values for the length of acceptable cement differ from those quoted for the same trials as described in the US patent application from which this application claims priority. When the logging tool is run in hole, the parameters used to detect acceptable cement are dependent on the expected compressive strength of the cement which is affected by depth, temperature and time. Due to the differing architecture of each of the test wells and ongoing operations on the rig, the parameters used to look for cement on each well and the time from pumping cement to logging were slightly different. To remove any discrepancies in the results that might arise from using varying parameters, the results were re-interpreted so as not to be constrained by the extent of setting of the cement (since the rate of setting varies with depth) but to look primarily for a cement bond. To achieve this a wide-ranging cut-off value was adopted to re-analyze the logs. By using this wider search parameter, all trial results were normalized and the effect of varying parameters from trial to trial was removed. The reanalysis of the logs was done after the initial patent application was filed, hence the change in values presented in this patent application.

All offshore trials were conducted in wells, or in parts of wells, which deviated from the vertical by a maximum of between 20 and 40 degrees. However, the inventors believe that the technique would work well in more deviated wells.

In alternative embodiments of the invention, the agitator may be placed further up the tubing, e.g. if the required cement column is very long and transmitting vibrations from the agitator both up and down the tubing may result in a longer length of tubing being sufficiently agitated to ensure good setting of cement. Alternatively, more than one agitator may be deployed at intervals along the tubing.

Alternative designs of agitator may be possible. For example, it may be preferable for the movement of the agitator to be caused e.g. by an electric motor, e.g. together with a cam mechanism of some sort. The motor may be powered via the wire line. In this way, more control of the timing and nature (amplitude, frequency, direction) of the vibrations may be achieved. Alternative ways to make the flow of cement or other fluid through or past the agitator cause vibration could also be considered. For example, static vanes or baffles of some sort may achieve the desired effect. However, the design of the agitator is not the subject of this invention.

In a further alternative embodiment of the invention, the production tubing may be perforated rather than being cut. Perforation may be achieved, for example, by a tool similar to that used for perforating tubing as part of a completion procedure, often known as a "perf gun". In this alternative embodiment, cement is delivered to the A annulus through the tubing perforations, rather than via an open end created by cutting. In this embodiment, it is not possible to place a single bridge plug across the full diameter of the well bore. However, the production packer and tubing plug are considered adequate to form a base for cement. In other respects, this embodiment is the same as the main embodiment described above.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention. Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

1. Cooke et al., "Primary Cementing Improvement by Casing Vibration During Cement Curing Time", *SPE Production Engineering*, August 1988.

The invention claimed is:

1. A process for through-tubing plugging of a hydrocarbon well for abandonment, wherein the well comprises a Xmas tree, a casing, with original cement between the casing and rock formation, and production tubing extending within the casing, the production tubing being centralized at the top and bottom of the well only, wherein a machined surface of the production tubing rests against a machined surface of the casing over a large proportion of the length of the production tubing, the process comprising the steps of:

(a) setting a plug in the production tubing;

(b) whilst leaving the casing and original cement in place, cutting or perforating the production tubing above the plug to create a cut end of the production tubing or perforations in a wall of the production tubing;

(c) injecting a settable medium into the production tubing such that it passes between the production tubing and the casing;

(d) during and/or after the injection of settable medium, moving or agitating the production tubing using an agitator device in order to allow or induce the sellable medium to pass all around the production tubing, wherein said agitator device is delivered through the Xmas tree into the production tubing to a desired point whereby said agitator device is located within the production tubing adjacent the cut end or perforations.

2. The process according to claim 1, wherein one or more additional agitator devices are placed at different points in the production tubing.

3. The process according to claim 1, wherein the agitator device is energized by an un-set settable medium, passing through the agitator device.

4. The process according to claim 1, wherein in step (b) the production tubing is cut to create a cut end and, prior to injection of the settable medium, an additional plug is placed across the internal diameter of the casing, adjacent the cut end.

5. The process according to claim 1, wherein the settable medium is cement.

6. The process according to claim 1, wherein the agitator device causes reciprocal movement or vibration of the production tubing which, in the region of the agitator, has a mean amplitude in the direction transverse to the tubing of at least 10 mm.

7. The process according to claim 1, wherein the agitator device causes reciprocal movement or vibration of the production tubing which, at a distance of 2000 ft along the tubing from the agitator, has a mean amplitude in the direction transverse to the tubing of at least 5 mm.

8. The process according to claim 1, wherein the agitator device causes reciprocal movement or vibration of the production tubing which, at a distance of 2000 ft along the tubing from the agitator, has a mean amplitude in the axial direction of at least 5 mm.

9. A process for plugging a hydrocarbon well for abandonment, wherein the well comprises a Xmas tree, a casing and production tubing, the production tubing being centralized at the top and bottom of the well only, wherein a machined surface of the production tubing rests against a machined surface of the casing over a large proportion of the length of the production tubing, the process comprising the steps of:

(a) setting a plug in the production tubing;

(b) cutting or perforating the production tubing above the plug to create a cut end of the production tubing or perforations in a wall of the production tubing;

(c) installing in the production tubing an agitator assembly capable of being run through production tubing in the hydrocarbon well, the assembly comprising:

(i) a packer capable of being activated to anchor the assembly at a selected point in the production tubing, whilst allowing fluid to flow through the production tubing; and, assembled thereto (ii) an agitator device for producing vibration or reciprocal movement of the tubing;

(d) injecting a settable medium into the production tubing such that it passes between the production tubing and the casing;

(e) during and/or after the injection of settable medium, moving or agitating the production tubing using the agitator device in order to allow or induce the settable medium to enter the full circumference of the annular space, wherein said agitator assembly is delivered through the Xmas tree into the production tubing to a desired point whereby said agitator device is located within the production tubing adjacent the cut end or perforations.

10. The process according to claim 9, wherein one or more additional agitator devices are placed at different points in the production tubing.

11. The process according to claim 9, wherein the agitator device is energized by an un-set settable medium, passing through the agitator device.

12. The process according to claim 9, wherein the settable medium is cement.

13. The process according to claim 9, wherein the agitator device causes reciprocal movement or vibration of the production tubing which, in the region of the agitator, has a mean amplitude in the direction transverse to the production tubing of at least 10 mm.

14. The process according to claim 9, wherein the agitator device causes reciprocal movement or vibration of the production tubing which, at a distance of 2000 ft along the tubing from the agitator, has a mean or minimum amplitude in the direction transverse to the production tubing of at least 5 mm.

15. The process according to claim 9, wherein the agitator device causes reciprocal movement or vibration of the production tubing which, at a distance of 2000 ft along the production tubing from the agitator, has a mean or minimum amplitude in the axial direction of at least 5 mm.

16. The process according to claim 9, wherein fluid flowing through the agitator device creates vibration or reciprocal movement of the production tubing.

17. The process according to claim 9, wherein the agitator assembly comprises a burst sub.

18. The process according to claim 9, wherein the agitator assembly comprises a running tool.

19. The process according to claim 9, wherein the agitator assembly comprises a non-return valve located between the agitator device and the packer.

* * * * *